United States Patent [19]

Poore et al.

[11] 4,399,793

[45] Aug. 23, 1983

[54] FUEL INJECTOR

[75] Inventors: Bernard B. Poore, East Moline, Ill.; Charles W. May, Cedar Falls, Iowa

[73] Assignee: Deere & Company, Moline, Ill.

[21] Appl. No.: 361,681

[22] Filed: Mar. 25, 1982

[51] Int. Cl.[3] ..... F02M 47/02

[52] U.S. Cl. ..... 123/502; 123/467; 123/387; 123/499; 239/533.5; 239/95; 239/92

[58] Field of Search ..... 123/467, 502, 501, 500, 123/506, 497, 499, 385, 387; 239/88, 89, 90, 91, 92, 93, 533.3, 533.4, 533.5, 95, 5; 417/318, 385, 498

[56] References Cited

U.S. PATENT DOCUMENTS

| | | | |
|---|---|---|---|
| 2,792,259 | 5/1957 | Shallenberg | 239/90 |
| 3,385,276 | 5/1968 | Reiners | 123/387 |
| 3,951,117 | 4/1976 | Perr | 123/502 |
| 4,134,549 | 1/1979 | Perr | 239/533.4 |
| 4,146,178 | 3/1979 | Bailey | 123/506 |
| 4,235,374 | 11/1980 | Walter et al. | 239/90 |
| 4,250,857 | 2/1981 | Taplin | 239/533.5 |
| 4,281,792 | 8/1981 | Sisson et al. | 239/5 |

FOREIGN PATENT DOCUMENTS

| | | | |
|---|---|---|---|
| 1196663 | 11/1959 | France | 123/499 |

*Primary Examiner*—Charles J. Myhre
*Assistant Examiner*—Carl Stuart Miller

[57] ABSTRACT

A fuel injector for use on an internal combustion engine which includes a housing enclosing a cylindrical barrel having a bore formed therein. The barrel cooperates with the housing to form an annular cavity therebetween. Axially movable within the bore is a plunger and a piston which are spaced apart. The housing also has a nozzle situated at one end which communicates with the bore for releasing fuel into the combustion chamber of the engine. Formed within the bore between the plunger and the piston is a timing chamber and formed between the piston and the nozzle is a metering chamber. Pressurized fluid is directed into the timing chamber, into the metering chamber and into one end of the annular cavity by passages which are arranged in the housing and in the barrel. The passage leading into the end of the annular cavity has a control valve positioned across it such that fluid pressure can be varied to that end of the annular cavity. Arranged within the annular cavity is a cylindrical sleeve valve which is spring biased to an open position. The cylindrical sleeve valve is movable in response to pressure variations in the end of the annular cavity between an open position allowing fluid flow into the timing chamber and a closed position preventing fluid flow into the timing chamber. By controlling the movement of the cylindrical sleeve valve, one can control both the timing of the discharge of fuel from the metering chamber through the nozzle and control the quantity of fuel stored in the metering chamber for subsequent discharge through the nozzle.

9 Claims, 3 Drawing Figures

FUEL INJECTOR

FIELD OF THE INVENTION

This invention relates to a fuel injector for an internal combustion engine and more particularly to a fuel injector having a cylindrical sleeve valve which controls the timing and metering of fuel through the injector nozzle.

BACKGROUND OF THE INVENTION

Fuel injectors have become common devices on internal combustion engines to control the timing and metering of fuel into the cylinders of the engine. Many fuel injectors are mechanically driven from the camshaft of the engine via a plunger, a cam, a cam follower and a rocker arm mechanism. Since the camshaft rotates in a fixed angular relationship with the crankshaft, the timing of the fuel injection was not adjustable with respect to other engine operating conditions. This presented a problem in that fuel was always injected into the combustion chamber at the same crankshaft position, irregardless of the engine load, speed and other conditions. Such injectors also require complex mechanisms to adjust the metered fuel quantity with respect to these same conditions. Solutions to this problem were presented in U.S. Pat. Nos. 4,235,374 and 4,281,792. in these patents, the fuel injector utilizes a single slide valve which controls the timing and the metering functions of the injector. The movement of the valve is electronically controlled by a solenoid so that rapid movement is possible but a sealing problem is still present. The sealing problem is critical because leakage tends to occur during the downward stroke of the plunger wherein very high injection pressures are created. In addition to the high pressure, the control valve must be able to reciprocate very rapidly thereby compounding the sealing problem.

Now a fuel injector has been invented which utilizes a cylindrical sleeve valve to control the leakage problem when high pressures are created within the timing or metering chambers of the injector.

SUMMARY OF THE INVENTION

Briefly, this invention relates to a fuel injector for an internal combustion engine which is better adapted at preventing leakage during high pressure periods of injection. The fuel injector includes a housing enclosing a cylindrical barrel having a bore formed therein. Formed between an outer surface of the barrel and an inner surface of the housing is an annular cavity. The fuel injector also contains a plunger and a piston which are movable within the bore of the barrel and are spaced apart from each other. Located at one end of the bore, remote from the plunger, is a nozzle which regulates the release of fuel into the combustion chamber of the engine. Formed in the bore between the plunger and the piston is a timing chamber and formed in the bore between the piston and the nozzle is a metering chamber. Pressurized fluid is routed through passages formed in the housing and the barrel for introducing fuel into the timing and into the metering chamber in relation to the positions of the piston and plunger. The passages are so arranged such that from the pressurized source, one passage leads to the timing chamber, one passage leads to the metering chamber and one passage leads to one end of the annular cavity formed between the barrel and the housing. The flow of fluid into the timing chamber is controlled by a cylindrical sleeve valve which is reciprocably arranged in the annular cavity and is movable relative to pressure variations in the end of the annular cavity. The pressure variations in the end of the annular cavity are varied by a control valve positioned across the respective passage. The cylindrical sleeve valve is adapted for sealing the fluid in the high pressure timing chamber because it is concentrically arranged about the barrel and seals the high pressure directly within the body of the plunger without additional transfer passages or sealing means.

The general object of this invention is to provide a fuel injector which utilizes a cylindrical sleeve valve to seal the high pressure chamber of the injector. A more specific object of this invention is to provide a fuel injector with a cylindrical sleeve valve for controlling both the timing of discharge of fuel from the metering chamber through the nozzle and for controlling the quantity of fuel stored in the metering chamber subsequent to the discharge of fuel.

Another object of this invention is to provide a fuel injector having a cylindrical sleeve valve located close to the pressure chambers for preventing fuel leakage therefrom during high pressure situations.

Still another object of this invention is to provide an economical fuel injector having a cylindrical sleeve valve which is also simple to construct.

Other objects and advantages of the present invention will become more apparent to those skilled in the art in view of the following description and the drawings.

DESCRIPTION OF THE PREFERRED EMBODIMENT

Figure 2:
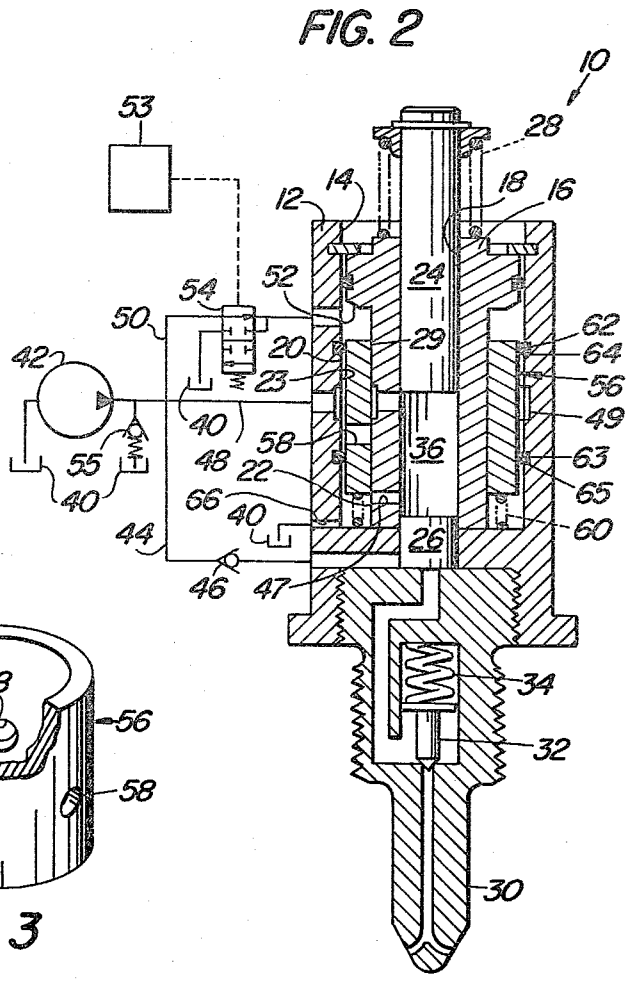
FIG. 2 is a partial sectional view of the fuel injector showing the cylindrical sleeve valve in a closed position.
Figure 1:
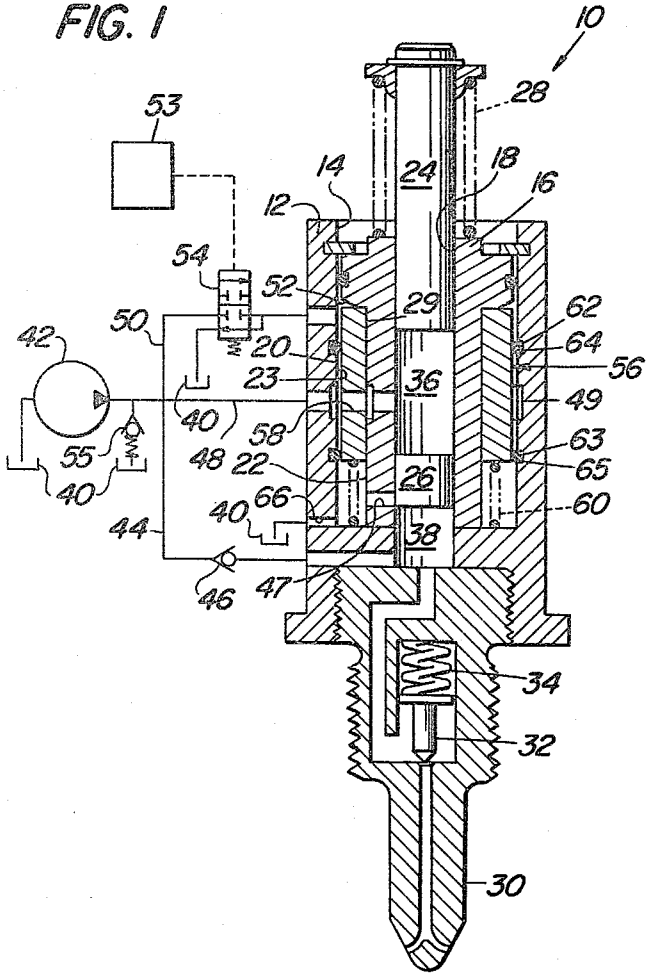
FIG. 1 is a partial sectional view of a fuel injector having the cylindrical sleeve valve in an open position.

Referring to FIGS. 1 and 2, a fuel injector 10 is shown having a housing 12 with an axial bore 14 formed therein. Enclosed within the axial bore 14 is a cylindrical barrel 16 which contains a bore 18. An inner surface 20 of the housing 12 cooperates with an outer surface 22 of the barrel 16 to form an annular cavity 23 therebetween, the function of which will be explained shortly. Axially positioned within the bore 18 of the barrel 16 is a plunger 24 and a piston 26, both of which are spaced apart from each other. The plunger 24 is biased upwards by a spring 28 and has its movement controlled by a mechanical linkage attached to the camshaft of the engine. The mechanical linkage is well known to those skilled in the art and consists of a rocker arm mechanism, a cam and a cam follower. The piston 26 on the other hand is axially movable within the bore 18 by fluid pressure. Situated at one end of the housing 12 and in communication with the bore 18 is a nozzle 30 which regulates the release of fuel into the combustion chamber of the engine. The nozzle 30 regulates the release of fuel via the actuation of a differential area poppet valve 32 which is biased to a closed position by a spring 34, as shown in FIG. 2.

Defined in the bore 18 of the barrel 16 is a timing chamber 36 formed between the plunger 24 and the piston 26 and a metering chamber 38 formed between the piston 26 and the nozzle 30, see FIG. 1. Fluid to these two chambers 36 and 38 is supplied from a reservoir 40 and is pressurized by a pump 42. From the pump 42, the pressurized fluid is routed to the bottom of the metering chamber 38 by a first passage 44 having a check valve 46 positioned thereacross. The check valve 46, which can be a standard ball-type check valve, assures that fluid flow can be routed only in one direction, that being into the metering chamber 38. A relief port 47 is also formed in the barrel 16 and permits fluid to flow out of the timing chamber 36 when the piston 26 is at the bottom of its stroke. The relief port 47 is of a very small diameter to insure that fluid flow is always outward from the pressurized chamber 36 to the reservoir 40. In addition, it should be noted that the relief port 47 is never open to the metering chamber 38, not even when the piston 26 is raised to its upper position.

A second passage 48, which connects the pump 42 to the timing chamber 36, extends through both the housing 12 and the barrel 16. Preferably, the second passage 48 opens into an annulus 49 formed about a portion of the inner wall 20 of the housing 12. The annulus 49 allows the fluid to enter the timing chamber 36 at various places about its perimeter. A third passage 50 connects the pump 42 to an upper end 52 of the annular cavity 23. Positioned across the third passage 50 is a control valve 54 which regulates the flow to the upper end 52 of the annular cavity 23. The control valve 54 is movable between two positions by a control mechanism 53. In the first position, fluid flow is permitted from the pump 42 to the upper end 52 of the annular cavity 23, and in the second position, fluid flow from the pump 42 is blocked by the control valve 54 and instead the upper end 52 of the annular cavity 23 is connected to the reservoir 40. This hydraulic arrangement ensures that there is either a pressurized force in the upper end 52 of the annular cavity 23 or that the upper end 52 of the annular cavity 23 is at zero pressure.

A relief valve 55 can be connected across the second passage 48, downstream of the pump 42, such as to relieve excess pressure from the system. The relief valve 55, preferably a spring-biased check valve, is connected to the reservoir 40 and is designed to open at a predetermined value such as to prevent physical damage to the system.

Figure 3:
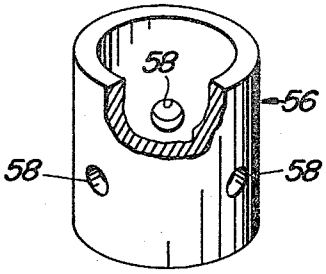
FIG. 3 is a perspective view of the cylindrical sleeve valve.

Arranged within the annular cavity 23, in intersecting relationship to the passage 40, is a cylindrical sleeve valve 56, best shown in FIG. 3, having at least one port 58 formed therein. When more than one port 58 is present, all the ports 58 should be so arranged that their central axes lie on one plane which is perpendicular to the elongated central axis of the sleeve valve 56. The cylindrical sleeve valve 56 is biased by a spring 60 to an open position wherein the port(s) 58 is/are aligned with the second passage 48 thereby allowing fluid flow into or out of the timing chamber 36. The cylindrical sleeve valve 56 is movable to a down position by an influx of pressure into the upper end 52 of the annular cavity 23, such influx being permitted by movement of the control valve 54 to its first position shown in FIG. 2. As shown in FIG. 2, the cylindrical sleeve valve 56 is in a down position wherein the port(s) 58 is/are out of alignment with the second passage 48 thereby blocking fluid flow into the timing chamber 36.

Located on the outer circumference of the cylindrical sleeve valve 56 are a pair of seals 62 and 63 which minimize leakage between the outer surface 20 of the housing 12 and the outer surface of the cylindrical sleeve valve 56. The seals 62 and 63 are positioned in annular grooves, 64 and 65 respectively, so as to maintain a stationary position irregardless of the reciprocal movement of the cylindrical sleeve valve 56.

The fuel injector 10 also has a drain passage 66 formed in the housing 12 which communicates between a lower end of the annular cavity 23 and the reservoir 40. The drain passage 66 eliminates the occurance of a fluid lock in the lower end of the annular cavity 23 thereby permitting the cylindrical sleeve valve 56 to move throughout its entire length of travel.

OPERATION

Starting with FIG. 2 wherein the plunger 24 and the piston 26 are both in a down position and the fuel in the metering chamber 38 has been injected through the nozzle 30 into the combustion chamber of the engine, the operational sequence is as follows: with the cylindrical sleeve valve 56 in the down or closed position blocking fuel flow to the timing chamber 36, the plunger 24 starts its upward movement via the force of the spring 28. Initial upward movement of the plunger 24 will cause the piston 26 to move likewise due to a low pressure created above it. The piston 26 will then move further upward as the plunger 24 moves upward because pressurized fuel from the pump 42 will be impinging on the bottom of the piston 26 while the pressure on the top of the piston 26 will be at a lesser value. The piston 26 will continue to follow the upward movement of the plunger 24 until a desired quantity of fuel has been inserted into the metering chamber 38. At this instant, the control valve 54 is moved by a signal from the control mechanism 53 to its second position, see FIG. 1, such that the incoming pressure in the third passage 50 is blocked off and the pressure at the upper end 52 of the annular cavity 23 is open to the reservoir 40. This allows any pressurized fuel in the upper end 52 of the annular cavity 23 to drain out. Simultaneously, the cylindrical sleeve valve 56 is moved upwards by the force of the spring 60 such that the ports 58 are in alignment with the second passage 48 thereby allowing fuel to flow into the timing chamber 36. As the plunger 24 continues its upward movement, pressurized fuel will enter the timing chamber 36 and neutralize the pressure on the top and bottom surfaces of the piston 26, thereby making it stationary. Pressurized fuel will continue to enter the timing chamber 36 until the plunger 24 has reached the top of its stroke, as shown in FIG. 1. The plunger 24 will then start its downward stroke, via the force of the rocker arm mechanism operated off of the camshaft, and some of the fuel in the timing chamber 36 will be pushed out through the second passage 48. This outflowing fuel can be relieved through the relief valve 55 which is associated with the second passage 48 should the pressure become too high.

The control mechanism 53 actuates the control valve 54 at the precise time required for the timing of fuel injection into the combustion chamber. At this desired time, the control valve 54 is moved to its first position wherein fuel flow is allowed to pass through the second passage 50 to the upper end 52 of the annular cavity 23 thereby causing the cylindrical sleeve valve 56 to move to its closed position compressing the spring 60. At this point, no more pressurized fuel is allowed to pass out of the timing chamber 36 and therefore the piston 26 becomes hydraulically coupled to the plunger 24 and will move downward therewith. As the piston 26 moves downward, the fuel within the metering chamber 38 is injected through the nozzle 30 and into the combustion chamber of the engine. As the fuel is injected through the nozzle 30, the plunger 24 and the piston 26 will move to the bottom of their strokes, as indicated in FIG. 2, and the cycle is completed. At the bottom of the stroke, the piston 26 uncovers the relief passage 47 and pressure in the timing chamber 36 is relieved. This allows the plunger 24 to complete its downward travel without hydraulic lock occurring and without damage to the driving mechanism. It should be noted that the above sequence occurs very rapidly, within a fraction of a second, and the pressures created within the timing chamber 36 and the metering chamber 38 can be very high.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

What is claimed is:

1. A fuel injector operable relative to a combustion chamber of an internal combustion engine, said injector comprising:

(a) a housing containing a cylindrical barrel therein and having an annular cavity formed between an inner surface of said housing and an outer surface of said barrel, said barrel having a bore formed therein;

(b) a plunger and a piston spaced therefrom, said plunger and piston being positioned within said bore for axial movement;

(c) a nozzle situated at an end of said bore remote from said plunger for releasing fuel into said combustion chamber;

(d) a timing chamber defined in said bore between said plunger and said piston adapted to receive fluid to create a hydraulic coupling between said plunger and said piston;

(e) a metering chamber defined in said bore between said piston and said nozzle;

(f) passages in said housing and said barrel for receiving pressurized fuel and transmitting said fuel into said timing chamber, into said metering chamber and into an end of said annular cavity;

(g) control means for varying the flow of pressurized fuel through one of said passages and into said end of said annular cavity; and (h) cylindrical sleeve valve means for controlling both the timing of discharge of fuel from said metering chamber through said nozzle and for controlling the quantity of fuel stored in said metering chamber subsequent to said discharge of fuel, said valve means biasly arranged in said annular cavity and movable in response to pressure variations in said end of said annular cavity.

2. The fuel injector of claim 1 wherein said cylindrical sleeve valve controls the admission of fuel at supply pressure into said timing chamber creating a hydraulic link between said plunger and said piston to selectively hydraulically connect said plunger to said piston.

3. The fuel injector of claim 2 wherein said cylindrical sleeve valve is movable between an open and a closed position, when in said open position fuel flow is permitted into and out of said timing chamber to permit independent movement of said plunger relative to said piston during a portion of the operation of said fuel injector.

4. The fuel injector of claim 1 wherein said cylindrical sleeve valve is situated across one of said passages which leads into said timing chamber for controlling the coupling of said plunger to said piston.

5. The fuel injector of claim 1 wherein said cylindrical sleeve valve is biased by a spring.

6. The fuel injector of claim 5 wherein said cylindrical sleeve valve is spring biased to an open position.

7. The fuel injector of claim 1 wherein said cylindrical sleeve valve contains a passageway formed therein and is operable between an open position wherein said passageway is aligned with one of said passages extending into said timing chamber for permitting fuel flow therethrough and a closed position wherein said passageway is out of alignment with said passage extending into said timing chamber thereby blocking fuel flow therethrough.

8. A fuel injector, comprising:

(a) a housing enclosing a cylindrical barrel with a bore formed therein, said cylindrical barrel cooperating with an inner surface of said housing to form an annular cavity therebetween;

(b) a plunger and a piston spaced therefrom, said plunger and piston being positioned within said bore for axial movement;

(c) a nozzle situated at an end of said bore remote from said plunger for releasing fuel into said combustion chamber;

(d) a timing chamber defined in said bore between said plunger and said piston adapted to receive fuel to create a coupling between said plunger and said piston;

(e) a metering chamber defined in said bore between said piston and said nozzle;

(f) a source of pressurized fuel;

(g) a first passage formed in said housing connecting said source of pressurized fuel to said metering chamber;

(h) a second passage formed in both said housing and said cylindrical barrel and intersecting said annular cavity, said second passage connecting said source of pressurized fuel to said timing chamber;

(i) a third passage formed in said housing connecting said source of pressurized fuel to an end of said annular cavity;

(j) a control valve positioned between said source of pressurized fuel and said third passage for regulating fuel flow therebetween, said control valve operable between a first position permitting fuel flow from said source of pressurized fuel to said end of said annular cavity and a second position blocking fuel flow therebetween while connecting said end of said annular cavity to a sump;

(k) a check valve positioned between said source of pressurized fuel and said first passage for preventing fuel flow out of said metering chamber; and (l) cylindrical sleeve valve means for controlling both the timing of discharge of fuel from said metering chamber through said nozzle and for controlling the quantity of fuel stored in said metering chamber subsequent to said discharge of fuel, said valve means being biasly arranged in said annular cavity and movable in response to pressure variations in said end of said annular cavity.

9. A fuel injector for an internal combustion engine comprising:

(a) a housing having an axial bore formed therein;

(b) a nozzle positioned at one end of said housing and adapted for communicating with a combustion chamber of said engine, said nozzle enclosing a pressure activated valve which regulates fluid flow through said nozzle;

(c) a cylindrical barrel positioned in said axial bore of said housing, said barrel having an elongated bore extending therethrough and communicating with said nozzle, an outside surface of said barrel cooperating with an inner surface of said housing to form an annular cavity therebetween;

(d) a plunger positioned in said elongated bore and being axially movable therein in relation to changing engine parameters;

(e) a piston movably positioned in said elongated bore and located apart from said plunger;

(f) a timing chamber defined in said elongated bore between said plunger and said piston;

(g) a metering chamber defined in said elongated bore between said piston and said nozzle;

(h) a source of pressurized fuel;

(i) a first passage formed in said housing connecting said source of pressurized fuel to said metering chamber;

(j) a second passage formed in both said housing and said barrel and intersecting said annular cavity, said second passage connecting said source of pressurized fuel to said timing chamber;

(k) a third passage formed in said housing connecting said source of pressurized fuel to an end of said annular cavity;

(l) a control valve positioned between said source of pressurized fuel and said third passage for regulating fuel flow therebetween, said control valve operable between a first position permitting fuel flow from said source of pressurized fuel to said end of said annular cavity and a second position blocking fuel flow therebetween while connecting said end of said annular cavity to a sump;

(m) a check valve positioned between said source of pressurized fuel and said first passage for preventing fuel flow out of said metering chamber;

(n) a cylindrical sleeve valve positioned in said annular cavity and having a passageway formed therein, said sleeve valve operable between an open position in which said passageway is aligned with said econd passage and fuel flow is permitted from said source of pressurized fuel to said timing chamber and a closed position in which said passageway is out of alignment with said second passage and fuel flow is blocked to said timing chamber;

(o) a relief valve positioned across said second passage for relieving excess fluid pressure downstream of said control valve; and (p) biasing means cooperating with said cylindrical sleeve valve for urging said sleeve valve toward said open position.

* * * * *

UNITED STATES PATENT AND TRADEMARK OFFICE

CERTIFICATE OF CORRECTION

PATENT NO. : 4,399,793

DATED : 23 August 1983

INVENTOR(S) : Bernard B. Poore and Charles W. May

It is certified that error appears in the above-identified patent and that said Letters Patent is hereby corrected as shown below:

Column 8, line 19, delete "econd" and insert -- second --.

Signed and Sealed this

*Thirty-first* Day of *January 1984*

[SEAL]

*Attest:*

GERALD J. MOSSINGHOFF

*Attesting Officer*

*Commissioner of Patents and Trademarks*